US005806695A

United States Patent [19]

Hytonen

[11] Patent Number: 5,806,695

[45] Date of Patent: Sep. 15, 1998

[54] METHOD FOR THE CONTROL OF A HARMONICALLY OSCILLATING LOAD

[76] Inventor: Kimmo Hytonen, Ristiaallokonkatu 6 B 38, FIN-02320 Espoo, Finland

[21] Appl. No.: 436,196

[22] PCT Filed: Nov. 16, 1993

[86] PCT No.: PCT/FI93/00483

§ 371 Date: Dec. 3, 1996

§ 102(e) Date: Dec. 3, 1996

[87] PCT Pub. No.: WO94/11293

PCT Pub. Date: May 26, 1994

[30] Foreign Application Priority Data

Nov. 17, 1992 [FI] Finland ..... 925212

[51] Int. Cl.[6] ..... B66C 19/00

[52] U.S. Cl. ..... 212/270; 212/275

[58] Field of Search ..... 340/685; 212/275, 212/276, 270

[56] References Cited

U.S. PATENT DOCUMENTS

| | | | |
|---|---|---|---|
| 4,603,783 | 8/1986 | Tax et al. | 212/275 |
| 4,756,432 | 7/1988 | Kawashima et al. | 212/275 |
| 5,219,420 | 6/1993 | Kiiski et al. | 212/275 |

*Primary Examiner*—Thomas J. Brahan
*Attorney, Agent, or Firm*—Skinner and Associates; Joel D. Skinner, Jr.

[57] ABSTRACT

The object of the invention is a method to control a harmonically oscillating load, in which method the load is transferred from a beginning state to a final state of the load oscillation and to a final velocity ($V_{ref}$) of the point of suspension by controlling the load with control sequences which comprise consecutive acceleration pulses, whereby the beginning and final states of load oscillation and the beginning and final velocities of the point of suspension are measured or estimated. The control sequence a(t) of the load is formed from many standard duration acceleration pulses ($a_1$, $a_2$, $a_3$) calculated on the basis of random beginning and final states of the load.

11 Claims, 3 Drawing Sheets

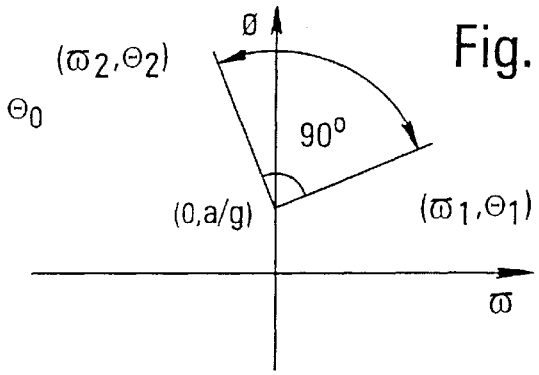
Fig. 4
Fig. 5
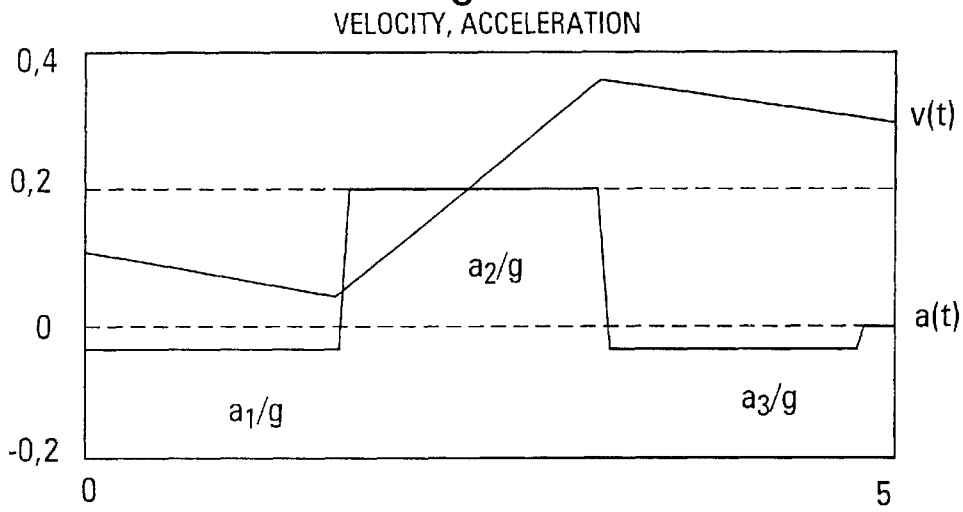
Fig. 6
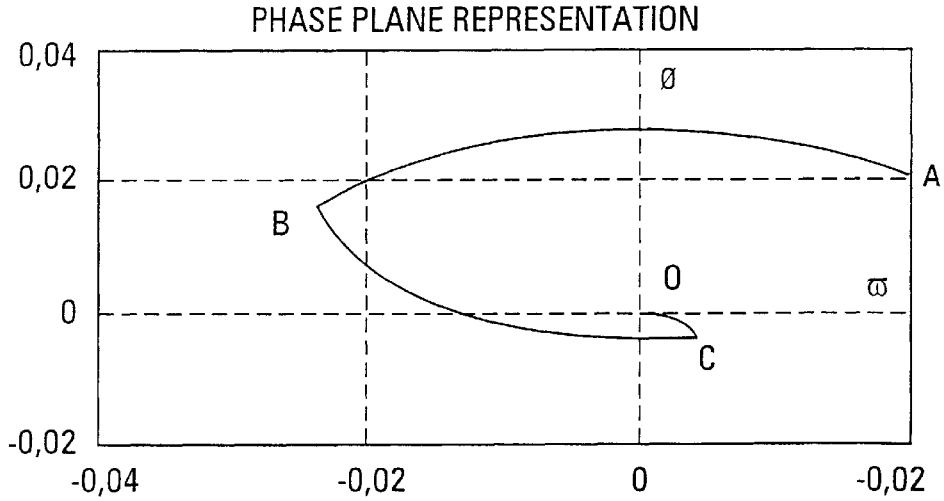

METHOD FOR THE CONTROL OF A HARMONICALLY OSCILLATING LOAD

The object of the invention is a method for the control of a harmonically oscillating load, in which method the load is transferred from the initial state to the final state of the oscillation of the load and to the final velocity of the point of suspension by controlling the load with control sequences, which consist of consecutively performed acceleration pulses, in which method the beginning or initial states of the oscillation of the load and the beginning or initial velocity of the point of suspension are either measured or estimated, and in which method the desired final states of oscillation of the load and the desired final velocity of the point of suspension are set by a human operator or, in the case of an automatic crane, by a computer.

A method is already known from the publication "Sub-optimal control of the roof crane by using the microcomputer," by S. Yamada, H. Fujikawa, K. Matsumoto, IEEE CH1897-8/83/0000-0323, pp 323–328, in which, at constant acceleration, variable acceleration and switching times are pre-calculated and tabulated for the load suspending apparatus so that, by using the acceleration and switching times, the velocity of the load suspending apparatus, the oscillating angle of the suspended load, and the angular velocity of the oscillation of the suspended load are steered from certain starting values to desired final values. In this method, the phase plane is divided into squares, and switching times for acceleration are calculated and entered for each phase plane square. Consequently, the system moves at the desired final velocity and the suspended load is in a stationary state. The method uses constant acceleration, and the acceleration switching times are adjusted to achieve the desired final result. When using this method, if all possible starting and finishing situations are allowed, the table will be extremely large. In the method presented in the publication in question, the acceleration pulses are, in terms of absolute value, constantly large or at the value zero. In addition, the duration of the acceleration pulses is calculated iteratively and not directly by calculation.

Furthermore, the magnitude of acceleration is partly determined so that, for example, the first acceleration pulse is, in terms of magnitude, the same as the third acceleration pulse. Considering the phase plane presentation, in the above publication the position of the centre point of the trajectory of the acceleration pulse is determined, but the length of the curve varies.

In addition a method is known which, by summing the oscillation-eliminating acceleration sequences known from patent publication U.S. Pat. No. 3,517,830, succeeds in forming a velocity instruction for the load suspending apparatus which guides the load suspending apparatus to the desired final velocity in such a way that the oscillating angle of the suspended load is zero and the angular velocity of the suspended load's oscillation is zero. The use of this method is limited by the requirement for a stationary beginning situation of the suspended load and by the need to achieve a particular final situation concerning the oscillating angle and angular velocity of the suspended load. The method is not therefore suited to the guiding of a suspended load's suspension apparatus and the angular velocity of the suspended load to desired, random situations from completely random beginning values. The solution presented in publication U.S. Pat. No. 3,517,830 requires stationary beginning and final situations and its disadvantage is that it does not allow control adjustments in mid-control, but the sequence must be carried through to the end.

The disadvantage of the known methods is that they do not offer a simple, calculationally-advantageous method of calculating the velocity instructions for a suspended load's suspension apparatus, which would guide the load's suspension apparatus to a desired random final velocity, and suspended load oscillating angle, and angular velocity of the suspended load oscillating angle, starting from random beginning values.

The purpose of the invention is to solve the problems described above. The said problem is solved by a method in accordance with the invention now presented, characterized by the fact that the load control sequence is formed from a plurality of acceleration pulses, each pulse having a constant rate of acceleration. The load control sequence provides a general solution for controlling a harmonically oscillating load for any arbitrary initial or desired final value of swing angle, angular speed, and velocity of the point of suspension. Considering the phase plane representation, in the solution according to the invention, the location of the centre point of the acceleration pulse trajectory varies with the variation in the acceleration pulse value or magnitude, but the length of the trajectory curve is stable or at least pre-determined.

The invention offers a calculationally-advantageous way to define the suspended load's acceleration and deceleration so that, starting from any beginning velocity of the point of suspension of the suspended load, any oscillating angle of the suspended load and any angular velocity of the oscillating angle of the suspended load, it is possible to finish with any velocity of the point of suspension of the suspended load, any oscillating angle of the suspended load and any angular velocity of the oscillating angle of the suspended load in a desired, pre-determined time. Furthermore, the invention is calculationally-advantageous because it uses a previously set number of acceleration pulses of a previously set duration, and because the magnitude of the pulses are easily calculated using simple equations based on the initial and desired final values of swing angle, angular speed, and velocity of the point of suspension. The invention may be utilized in the control of all suspension systems where, due to the method of suspension, there is harmonic oscillation of the load. The invention is adaptable, for example, to overhead cranes.

The developed method is especially suitable for use in equipment where the position of the suspended load is measured. Then with the method it is possible to rapidly calculate the control for guiding the load to the desired position and velocity. In systems in which the position of the load is not measured, the beginning values for the oscillating angle and the angular velocity of the load are estimated using a mathematical model.

In the following, the invention is explained with reference to the attached figures, in which FIG. 1 shows the principles of harmonic oscillation, FIG. 2*a* shows a velocity sequence known per se, FIG. 2*b* shows a phase plane representation corresponding to FIG. 2*a,*

FIG. 3*a* shows another velocity sequence known per se,

FIG. 3*b* shows a phase plane representation corresponding to FIG. 3*a,*

FIG. 4 shows a phase plane representation,

FIG. 5 shows the velocity and acceleration coefficient,

FIG. 6 shows a phase plane representation corresponding to FIG. 5,

Figure 1:
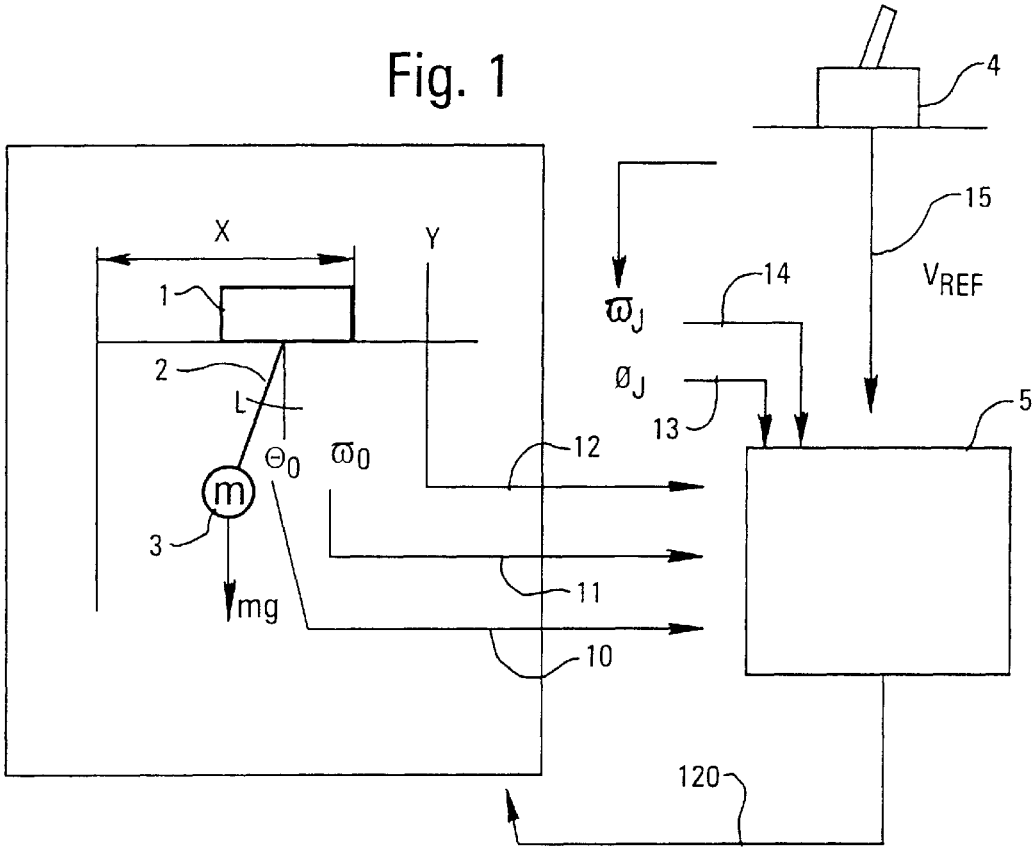

With reference to FIG. 1 the following symbols are shown:

$X_r$=the position of the suspension point in the x direction $X_t$=the position of the suspended load in the x direction $Y_t$=the position of the suspended load in the y direction l=the length of the suspension rope of the load g=the gravitational acceleration m=the mass of the load The position of the suspended load is obtained from FIG. 1 by the equations (1) and (2).

$$X_t = X_r - l \cdot \sin \Theta \tag{1}$$

$$Y_t = l \cdot \sin \theta \tag{2}$$

The kinetic energy of the load W is obtained from the formula (3).

$$W = \frac{1}{2} m \left( \left( \frac{dx_t}{dt} \right)^2 + \left( \frac{dy_t}{dt} \right)^2 \right) \tag{3}$$

By combining equations (1) and (2) with equation (3) we obtain the kinetic energy of the suspended load on the polar coordinates (4).

$$W = \frac{1}{2} \left( x_r^2 - 2l \frac{d\theta}{dt} \frac{dx_r}{dt} \cos\theta + \left( l \frac{d\theta}{dt} \right)^2 \right) \tag{4}$$

The potential energy of the load is obtained from FIG. 1 by equation (5).

$$V = -mgl \cos \theta \tag{5}$$

As is known, the Lagrange function is $$L = W - V. \tag{6}$$

By combining equations (4) and (5) with equation (6), the Lagrange function in this case is equation (7).

$$L = \frac{1}{2} m \left( x_r^2 - 2l \frac{d\theta}{dt} \frac{dx_r}{dt} \cos\theta + \left( l \frac{d\theta}{dt} \right)^2 \right) + mgl\cos\theta \tag{7}$$

The system's equation of motion is derived from the Lagrange function L by combining it with the Lagrange equation of motion (8).

$$\frac{d}{dt} \left( \frac{\partial L}{\partial \left( \frac{dq_1}{dt} \right)} \right) - \frac{\partial L}{\partial q_1} = Q_1 \tag{8}$$

where

L=the Lagrange function $q_i$=the i:th coordinate $Q_i$=the force having effect from outside the system.

By combining the derived Lagrange function (7) with the Lagrange equation of motion (8) and by performing the derivations we obtain the equation (9) as the system's equation of motion.

$$\frac{d^2\theta}{dt^2} + \frac{g}{l} \sin\theta = \frac{d^2x_r}{dt^2} \frac{1}{l} \cos\theta \tag{9}$$

With a small oscillating angle ($\Theta < 10°$) $\sin \Theta \approx 0$ and $\cos \Theta \approx 1$.

With these assumptions the equation (9) simplifies to the form (10).

$$\frac{d^2\theta}{dt^2} = -\frac{g}{l} \left( \theta - \frac{d^2x_r}{dt^2} \frac{1}{g} \right) \tag{10}$$

It can be seen from equation (10) that the oscillating angle $\Theta$ of the suspended load is controlled by the acceleration of the load's suspension point $x_r$. The phase plane representation can be achieved from the equation (10) by multiplying the equation with $d\Theta/dt$ to achieve equation (11).

$$\frac{d\theta}{dt} \frac{d^2\theta}{dt^2} = -\frac{d\theta}{dt} \frac{g}{l} \left( \theta - \frac{d^2x_r}{dt^2} \frac{1}{g} \right) \tag{11}$$

According to the rule $$\frac{1}{dt} \left( \frac{d\theta}{dt} \right)^2 = 2 \frac{d\theta}{dt} \frac{d^2\theta}{dt^2} \tag{12}$$

the equation (13) is obtained from the equation (11).

$$\frac{1}{2} \frac{d\left( \frac{d\theta}{dt} \right)^2}{dt} = -\frac{g}{l} \left( \theta - \frac{d^2x_r}{dt^2} \frac{1}{g} \right) \frac{d\theta}{dt} \tag{13}$$

By integrating the equation (13) in the $\Theta$ ratio, (14) is obtained.

$$\frac{1}{2} \left( \frac{d\theta}{dt} \right)^2 = -\frac{g}{l} \left( \frac{1}{2} \theta^2 - \theta \frac{d^2x_r}{dt^2} \frac{1}{g} \right) + C \tag{14}$$

When we assume that the system's beginning situation is a stationary state ($t=0$, $\Theta=0$, $d\Theta/dt=0$) the integration constant C is zero. Thus the equation (15) is obtained.

$$\left( \frac{d\theta}{dt} \right)^2 = -\frac{g}{l} \left( \left( \theta - \frac{d^2x_r}{dt^2} \frac{1}{g} \right)^2 - \left( \frac{d^2x_r}{dt^2} \frac{1}{g} \right)^2 \right) \tag{15}$$

By entering a for the acceleration of the point of suspension of the load, equation (16) is obtained from equation (15).

$$\left( \frac{d\theta}{dt} / \sqrt{\frac{g}{l}} \right)^2 = -\left( \left( \theta - \frac{a}{g} \right)^2 - \left( \frac{a}{g} \right)^2 \right) \tag{16}$$

and again by entering $$\omega = \frac{d\theta}{dt} / \sqrt{\frac{g}{l}} \tag{17}$$

we obtain equation (18).

$$\omega^2 + \left( \theta - \frac{a}{g} \right)^2 = \left( \frac{a}{g} \right)^2 \tag{18}$$

Figure 2A:
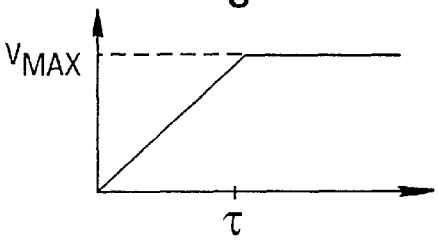
Figure 2B:
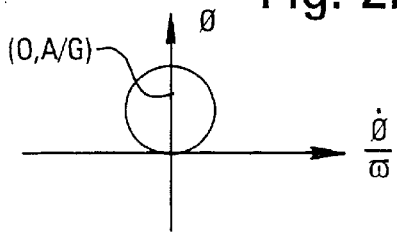

It can be seen from equation (18) that the load oscillation plots concentric circles in the phase plane (O,a/g). FIGS. 2*a*, 2*b*, 3*a* and 3*b* illustrate the phase plane representation. FIGS. 2*a* and 2*b* show a crane velocity sequence known per se and the corresponding phase plane representation. In the case of FIGS. 2*a* and 2*b* the system is accelerated at an even acceleration a by the time $\tau$ corresponding to the system's characteristic oscillation time. The characteristic oscillation time for the mathematical pendulum is obtained from the formula $$\tau = 2\pi\sqrt{\frac{t}{g}} \tag{19}$$

Figure 3A:
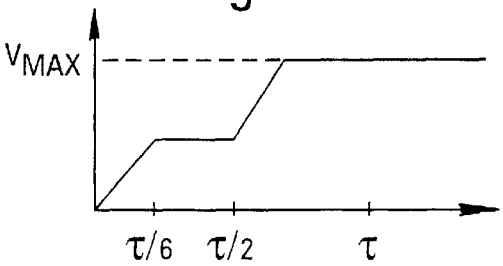
Figure 3B:
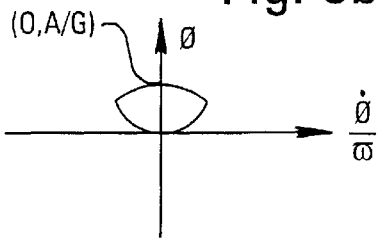

It can be seen from the phase plane that a concentric circle (O,a/g) is then plotted on the angle/angular velocity-coordinates. In FIGS. 3*a* and 3*b* the system is accelerated at sequences which comprise two constant acceleration pulses of length $\tau/6$ and a period of steady velocity of length $\tau/3$. The system was at the beginning situation in a stationary state of rest, so that the load's oscillating angle and angular velocity are zero. When the system is accelerated at an even acceleration a, a concentric circle (O, a/g) is plotted on the phase plane, which touches the beginning point (0.0). When in FIGS. 2*a* and 2*b* the system is accelerated at an even acceleration a and time $\tau$ (characteristic oscillation time), a complete circle is plotted on the phase plane. In FIGS. 3*a* and 3*b* the length of the first acceleration pulse is $\tau/6$, when a concentric circular arc (O, a/g) is plotted on the phase plane starting from the point (0.0), with the length of the arc being 360/6=60 degrees. The next step in the velocity sequence is a phase of even velocity, when the system's acceleration a=0. Then a concentric circular arc (0.0) is plotted on the phase plane starting from the point in the phase plane at which the previous acceleration sequence finished. As the length of the even velocity phase is $\tau/3$, a concentric arc whose length is 360/3=120 degrees is plotted on the phase plane. Finally the system is accelerated again at an acceleration a and time ($\tau/6$). Then a concentric arc (O,a/g) is again plotted on the phase plane, whose arc has a length of 360/6=60 degrees and which begins at the point where the previous acceleration pulse (constant velocity a=0) finished. It can be seen in FIG. 3*b* that the system states ended as zero after a period $\tau/6$. If the system's acceleration a continues to be zero, the system is moving at a constant velocity without load oscillation.

A harmonically oscillating load 3, for example on an overhead crane, is transferred from the beginning state to the final state of the load's oscillation and to the final velocity $V_{ref}$ of the point of suspension by controlling the load with a control sequence a(t), which comprises consecutively performed acceleration pulses $a_i$. In the method the beginning states of the load's oscillation and the beginning velocity of the point of suspension are measured or estimated. According to the invention the load's control sequence a(t) is formed from acceleration pulses having a constant duration and a constant rate of acceleration ($a_1$, $a_2$, $a_3$ . . . $a_n$) The control sequence a(t) selects acceleration pulses having a preset duration, a preset constant rate of acceleration, and a calculated magnitude based on any measured or estimated beginning value for the load's oscillating motion, on any desired finishing value for the load's oscillating motion, on any beginning velocity of the point of suspension, and on any desired finishing velocity of the point of suspension.

FIG. 4 also shows the phase plane formulas. With reference to FIG. 4, one of the calculationally-advantageous applications of the method according to the invention is a control which leads to the desired system final velocity, the desired oscillating angle and the desired final velocity of the load's angle of oscillation, by adapting three acceleration periods ($a_1$, $a_2$ and $a_3$) of length $\tau/4$ so that they perform the desired change in system velocity $\Delta$/v or dv.

$$\Delta v = \frac{\tau}{4}\,(a_1 + a_2 + a_3) \tag{20}$$

Because in a certain application of the method $\tau/4$ has been chosen as the i length of each acceleration period, each acceleration period corresponds to a circular arc (360/4=90) of 90 degrees covered in the phase plane, where the arc's centre point is (0,$a_i$/g), and the circular arc's beginning point is ($\omega_1$, $\Theta_1$) and the finishing point is ($\omega_2$, $\Theta_2$). When this acceleration period has ended, the system state has transferred from the point ($\omega_1$, $\Theta_1$) to the point ($\omega_2$, $\Theta_2$). Because the length of the acceleration period was chosen as $\tau/4$, the point ($\omega_2$, $\Theta_2$) can be calculated when in addition the acceleration $a_1$ is known from formulas (21) and (22).

$$\omega_2 = \frac{a_1}{g} - \theta_1 \tag{21}$$

$$\theta_2 = \omega_1 + \frac{a_1}{g} \tag{22}$$

In a certain application of the method a control is calculated which implements the desired change $\Delta$v of velocity of the point of suspension and after which the load's oscillating angle and angular velocity have transferred from the point ($\omega_0$, $\Theta_0$) of the phase plane to the point ($\omega_3$, $\Theta_3$) so that three periods $a_1$, $a_2$, $a_3$ of even acceleration and of length $\tau/4$ are used. Accelerations $a_1$, $a_2$, $a_3$ may be solved by the equations (23)–(29).

$$\omega_1 = \frac{a_0}{g} - \theta_0 \tag{23}$$

$$\theta_1 = \omega_0 + \frac{a_0}{g} \tag{24}$$

$$\omega_2 = \frac{a_1}{g} - \theta_1 \tag{25}$$

$$\theta_2 = \omega_1 + \frac{a_1}{g} \tag{26}$$

$$\omega_3 = \frac{a_2}{g} - \theta_2 \tag{27}$$

$$\theta_3 = \omega_2 + \frac{a_2}{g} \tag{28}$$

$$\Delta v = \frac{\tau g}{4}\left(\frac{a_1}{g} + \frac{a_2}{g} + \frac{a_3}{g}\right) \tag{29}$$

Of the variables of the equations (23)–(29), $\Delta$v, $\omega_0$, $\Theta_0$, $\omega_3$, $\Theta_3$ are known. The accelerations $a_1$, $a_2$, $a_3$ of the equations are solved so that the unknown variables $\omega_1$, $\Theta_1$, $\omega_2$, $\Theta_2$ are reduced away from the final equations. Thus for the accelerations $a_1$, $a_2$, $a_3$ the equations (30)–(32) are solved on the phase plane.

$$\frac{a_1}{g} = \frac{1}{2}\left(\frac{4\Delta v}{\tau g}\, y_3 - x_0\right) \tag{30}$$

$$\frac{a_2}{g} = \frac{1}{2}\,(y_3 - x_3 + x_0 + y_0) \tag{31}$$

$$\frac{a_3}{g} = \frac{1}{2}\left(x_3 - y_0 + \frac{4\Delta v}{\tau g}\right) \tag{32}$$

As an example we calculate the accelerations $a_1$, $a_2$, $a_3$ which guide the crane system from starting states $X_0=\omega_0=$ 0.02 rad/2, $Y_0=\Theta_0=0.02$ rad to the final states $X_3=\omega_3=0.0$ rad/2, $Y_3=\Theta_3=0.0$ rad, so that the velocity of the point of suspension changes from the beginning value 0.1 m/s to the final value 0.5 m/s, when the load's lifting height 1=10 m.

$$\tau = 2\pi\sqrt{\frac{l}{g}}$$

$$\tau = 2 \cdot 3{,}14\sqrt{\frac{10\text{m}}{9{,}81\ \text{m/s}^2}}$$

$$\tau = 6{,}3437\ \text{s}$$

$$\frac{a_1}{g} = \frac{1}{2}\left(\frac{4\Delta v}{\tau g} - y_3 - x_0\right)$$

$$\frac{a_1}{g} = \frac{1}{2}\left(\frac{4 \cdot (0{,}3 - 0{,}1)}{6{,}3437 \cdot 9{,}81} - 0 - 0{,}02\right)$$

$$\frac{a_1}{g} = -0{,}0036$$

$$\frac{a_2}{g} = \frac{1}{2}(y_3 - x_3 + x_0 + y_0)$$

$$\frac{a_2}{g} = \frac{1}{2}(0 - 0 + 0{,}02 + 0{,}02)$$

$$\frac{a_2}{g} = 0{,}02$$

$$\frac{a_3}{g} = \frac{1}{2}\left(x_3 - y_0 + \frac{4\Delta v}{\tau g}\right)$$

$$\frac{a_3}{g} = \frac{1}{2}\left(0 - 0{,}02 + \frac{4(0{,}3 - 0{,}1)}{6{,}3437 \cdot 9{,}81}\right)$$

$$\frac{a_3}{g} = -0{,}0036$$

The magnitudes of the accelerations $a_i$ are defined therefore by applying circular arcs, revolving anti-clockwise, to the phase plane, where the second coordinate of the centre point of the circles is $a_i/g$.

FIGS. 5 and 6 show a velocity and acceleration sequence and a corresponding phase plane formula for the case presented above. It can be observed from FIG. 5 that the acceleration sequence a(t) comprises three parts, whose magnitudes are as large as those calculated above, i.e. $a_1/g=-0.0036$, $a_2/g=0.2$ and $a_3/g=-0.0036$. Correspondingly in the phase plane we transfer anti-clockwise from the beginning point A (0.02, 0.02) via points B and C to the origin 0.

Figure 7:
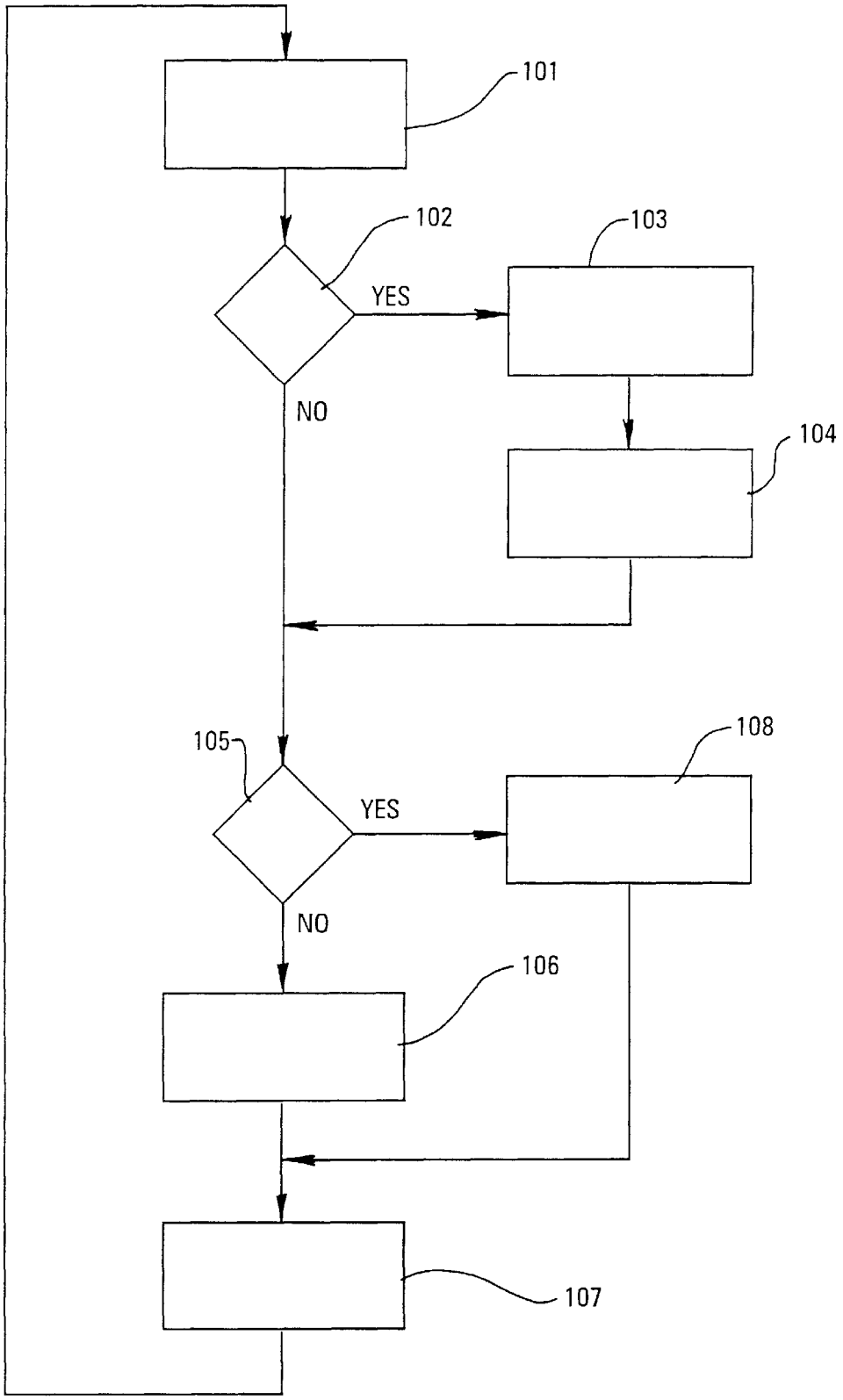
FIG. 7 shows a flow chart of the method according to the invention.

The harmonic oscillator presented in FIG. 1 may be for example an overhead crane which has a crane carriage 1 from which, by means of a suspension apparatus 2, a load 3 is suspended. The crane also has a control terminal 4 and control unit 5. The crane operator gives velocity instructions $V_{ref}$ from the control terminal which are directed via the control unit to the crane, or in practice to the crab traversing motors of the crane carriage 1. FIG. 7 shows a flow chart of the method according to the invention, but FIG. 7 can also be regarded as an internal block diagram of the control unit. With reference to FIGS. 1 and 7, the velocity instruction $V_{ref}$ given by the crane operator is read into the control unit 5 in the first block 101. In the next block, i.e. in the first testing block 102, the velocity instruction given by the operator is compared with the previous velocity instruction and, if it has changed, then in the next block 103 the oscillating angle $\Theta_0$ of the load 3 and the load's angular velocity $\omega_0$, which represent the beginning situation, are read into the control unit. In addition, in block 103 the desired velocity change dv is calculated. In the following block 104, standard duration (preferably $\tau/4$) new controls or acceleration pulses $a_1$, $a_2$, $a_3$ are calculated on the basis of the equations (30)–(32) presented above and are entered in a special programme performance table. In calculating the acceleration pulses we also utilize the desired final states, in other words the angular velocity $\omega$ and oscillating angle $\Theta$ of the load's final state.

In the following phase 106, after the second testing block 105, a new velocity instruction is calculated from the entered acceleration pulses $a_1$, $a_2$, $a_3$, which in the last block 107 is directed as an instruction to the crane's crab traversing motors. If it is noticed in the first testing block 102 that the velocity instruction $V_{ref}$ has not changed and if it is noticed in block 105 that the performance table is empty, then the velocity instruction $V_{ref}$ given by the operator is taken directly as the velocity in block 108, and is directed to the crane's crab traversing motors in accordance with block 107.

In FIG. 1 the random beginning states of the load, i.e. the oscillating angle $\Theta_0$ of the load 3 and the load's angular velocity $\omega_0$ and the load's velocity v are obtained from the feedback lines 10–12. The desired final states, i.e. the oscillating angle $\Theta_1$, of the load's final state, the angular velocity $\omega_1$ and the velocity instruction $V_{ref}$ are obtained from the control lines 13–15. The velocity change dv is obtained from the difference of lines 15 and 12.

The new velocity instruction obtained from the acceleration pulses $a_1$, $a_2$, $a_3$, calculated in the way according to the invention, is directed as a control to the crane's crab traversing motors via the control line 120.

In the method according to the invention, the magnitudes of the standard duration acceleration pulses are calculated on the basis of the desired velocity change dv of the point of suspension, as well as on the desired beginning and final values of the oscillating angle and the chosen duration time $\tau/n$ of the acceleration pulse. The value n is preferably 4, and this trigonometrically produces the best and most simple result in calculation from the point of view of the sine and cosine terms. In the method according to the invention the duration and switching times of the acceleration pulses performed at constant acceleration are predetermined.

Formulas (30)–(32) determine the magnitude of each standard duration acceleration pulse as a function of any arbitrary beginning and finishing state (the load's oscillating angle $\Theta$, the angular velocity $\omega$, the load's final velocity). Each acceleration pulse $a_1$, $a_2$, $a_3$ is solved directly by calculation, not therefore by iteration. In the method's embodiment, which is advantageous both in terms of calculation and the equipment solution, each acceleration pulse $a_1$, $a_2$, $a_3$ of the control sequence a(t) is calculated from a standard duration calculational approximation as presented by formulas (30)–(32). In that case, therefore, the constant duration parts or at least the parts of predetermined length of the acceleration sequence $a_i$ fulfilling the desired velocity change dv, in other words the acceleration pulses $a_1$, $a_2$, $a_3$ are each directly formed or calculated as a function of the load oscillation's random beginning and finishing states $X_0$, $Y_0$, $X_3$, $Y_3$ (where x stands for angular velocity $\omega$ and y stands for the oscillating angle $\Theta$), and further as a function of the desired velocity change $\Delta v$ or dv and the chosen individual acceleration pulse duration, which is preferably $\tau/4$, and further as a function of the gravitational acceleration g. In addition to the above, a preferable embodiment which improves the practicability of the method is that the approximations of the acceleration pulses are chosen so that, if the calculational factors to be used in forming each individual acceleration pulse $a_1$, $a_2$, $a_3$ so allow, the standard duration acceleration pulses and/or the acceleration pulses of predetermined length are formed to differ from each other in absolute value. The formation, i.e. calculation, of the magnitude of the acceleration pulses is therefore free of mutual initial settings which would restrict the application of the method.

One possible application for the invention may be a crane system in which the load's oscillating angle and angular velocity, and the velocity of the load's point of suspension may be freely controlled. In this case it is possible with the method according to the invention to calculate a control where the final result is that the load's velocity, oscillating angle and angular velocity are the desired values. For example, if the crane is stopped, but the load oscillates and the oscillating angle and the angular velocity can be measured or perfectly modelled with a mathematical model or simulator, it is possible with the method according to the invention to calculate the acceleration pulses whose number and duration are predetermined and after the performance of which the crane moves at the desired final velocity without oscillation of the load.

In a certain application it is possible to read from the operator's control terminal 4 the desired motion velocity $V_{ref}$ of the crane, i.e. the velocity at which the crane and the load 3 should move without load oscillation so that the load's oscillating angle and angular velocity are zero. In this application the load's oscillating angle and angular velocity are measured and the velocity is assumed to follow the desired velocity request of the control system exactly. When the velocity request given by the operator is changed, the load's oscillating angle, angular velocity and the velocities of the point of suspension are read at that moment, as well as the new desired non-oscillating, final velocity of the crane and load. These values are inserted in the formulas according to the invention, and calculations are made of the acceleration pulses, at the end of which the desired final velocity without load oscillation is achieved.

In a certain application of the invention, the load's oscillating angle is measured, and the velocity of the load's point of suspension follows exactly the velocity instruction of the control system. In this application, the dynamic model of the oscillation of the crane's load is exploited in the calculation of the angular velocity of load oscillation.

In a certain application of the invention the velocity of the point of suspension of the load follows exactly the velocity instruction given by the control system, and the load's oscillating angle or angular velocity is not measured, but the load's oscillating angle and angular velocity is assumed to behave according to a mathematical model or simulator describing the crane's dynamics.

In a certain application of the method according to the invention, the load's oscillating angle decreases evenly, whereupon the load's oscillating angle and angular velocity plot a spiral instead of a circle on the phase plane. This is taken into account in formulating the equations according to the invention so that the angular-angular velocity point is approached in a certain relationship to the centre point of the circular motion per each length unit of the arc moving in the circumference. It is a linear change which is reflected in the equations only as a coefficient and does not influence the solvability of the equations.

Although the invention is further explained in the examples given in the attached diagrams, it is clear that the invention is not limited only to these. It may be adapted on demand within the framework of the invention ideas here presented.

I claim:

1. A method for the control of a harmonically oscillating load, in which the load is transferred from a beginning state of oscillating movement of the load ($\theta_0$, $\omega_0$) and from a beginning velocity of a point of suspension of the load ($V_0$) to a desired final state of oscillating movement of the load ($\theta_{ref}$, $\omega_{ref}$) and to a desired final velocity ($V_{ref}$) of the point of suspension of the load, comprising the steps of:

(a) determining the beginning state of oscillating movement of the load ($\theta_0$, $\omega_0$) and the beginning velocity of the point of suspension of the load ($V_0$);

(b) determining the desired final state of oscillating movement of the load ($\theta_{ref}$, $\omega_{ref}$) and the desired final velocity of the point of suspension of the load ($V_{ref}$); and (c) controlling the load with a control sequence (a(t)) comprising consecutively performed acceleration pulses ($a_i$), wherein the control sequence a(t) is formed from a plurality of acceleration pulses ($a_1$, $a_2$, $a_3$ . . . $a_n$) having a constant rate of acceleration of a calculated magnitude and a predetermined duration, wherein the formed control sequence is based on the beginning and the desired final states of the oscillating movement of the load and on the beginning and the desired final velocity of the point of suspension of the load.

2. A method according to claim 1, further comprising the steps of determining a characteristic oscillation time ($\tau$) for the load, wherein the predetermined duration of each of the plurality of acceleration pulses is $\tau/4$, wherein the magnitudes of the acceleration pulses ($a_1$, $a_2$, $a_3$ . . . $a_n$) are calculated based on the desired velocity change ($V_{ref}-V_0$) of the point of suspension, the beginning and desired final values ($\theta_0$, $\theta_{ref}$) of the oscillating angle, the beginning and desired final values ($\omega_0$, $\omega_{ref}$) of the angular velocity, and the predetermined duration ($\tau/4$) of each acceleration pulse.

3. A method according to claim 2, wherein the beginning value of the load's oscillating angle ($\theta_0$) and of the angular velocity ($\omega_0$) are determined by a simulator describing the dynamics of a harmonic oscillator.

4. A method according to claim 2, further comprising the steps of entering the plurality of acceleration pulses ($a_1$, $a_2$, $a_3$, . . . $a_n$) in a program performance table, testing contents of the program performance table, and consecutively performing the acceleration pulses as the control sequence to be implemented for a set velocity change ($V_{ref}-V_0$).

5. A method according to claim 1, wherein the constant rate of acceleration of each acceleration pulse ($a_1$, $a_2$, $a_3$ . . . $a_n$) of the control sequence a(t) is determined via a calculational approximation.

6. A method according to claim 5, wherein the magnitude of the constant rate of acceleration differs in absolute value among the acceleration pulses.

7. A method according to claim 1, wherein the control sequence (a(t)) comprises three acceleration pulses ($a_1$, $a_2$, $a_3$), wherein each of the three acceleration pulses have a duration of $\tau/4$.

8. A method according to claim 1, wherein the beginning states of load oscillation and the beginning velocity of the point of suspension are measured.

9. A method according to claim 1, wherein the beginning states of load oscillation and the beginning velocity of the point of suspension are estimated.

10. A method for the control of a harmonically oscillating load, in which the load is transferred from a beginning state of oscillating movement of the load ($\theta_0$, $\omega_0$) and from a beginning velocity of a point of suspension ($V_0$) to a desired final state of oscillating movement of the load ($\theta_{ref}$, $\omega_{ref}$) and to a desired final velocity ($V_{ref}$) of the point of suspension, comprising the steps of:

(a) determining the beginning states of oscillating movement of the load ($\theta_0$, $\omega_0$) and the beginning velocity of the point of suspension of the load ($V_0$);

(b) determining the desired final states of oscillating movement of the load ($\theta_{ref}$, $\omega_{ref}$) and the desired final velocity of the point of suspension of the load ($V_{ref}$); and (c) controlling the load with a control sequence (a(t)) comprising consecutively performed acceleration pulses ($a_i$), wherein the control sequence a(t) is formed from a plurality of acceleration pulses ($a_1$, $a_2$, $a_3$ . . . $a_n$) having a constant rate of acceleration of a calculated magnitude and a predetermined duration, wherein the magnitudes of the acceleration pulses ($a_1$, $a_2$, $a_3$ . . . $a_n$) are determined via a calculational approximation based on the desired velocity change ($V_{ref}-V_0$) of the point of suspension, the beginning and desired final values ($\theta_0$, $\theta_{ref}$) of the oscillating angle and the beginning and desired final values ($\omega_0$, $\omega_{ref}$) of the angular velocity, and the predetermined duration of each acceleration pulse.

11. A method for the control of a harmonically oscillating load, in which the load is transferred from a beginning state of oscillating movement of the load ($\theta_0$, $\omega_0$) and from a beginning velocity of a point of suspension ($V_0$) to a desired final state of oscillating movement of the load ($\theta_{ref}$, $\omega_{ref}$) and to a desired final velocity ($V_{ref}$) of the point of suspension, comprising the steps of:

(a) determining the beginning states of oscillating movement of the load ($\theta_0$, $\omega_0$) and the beginning velocity of the point of suspension of the load ($V_0$);

(b) determining the desired final states of oscillating movement of the load ($\theta_{ref}$, $\omega_{ref}$) and the desired final velocity of the point of suspension of the load ($V_{ref}$);

(e) determining a characteristic oscillation time ($\tau$) for the load; and (f) controlling the load with a control sequence (a(t)) comprising consecutively performed acceleration pulses ($a_i$), wherein the control sequence a(t) is formed from a plurality of acceleration pulses ($a_1$, $a_2$, $a_3$) having a constant rate of acceleration of a calculated magnitude and a predetermined duration of $\tau/4$, wherein the magnitudes of the acceleration pulses ($a_1$, $a_2$, $a_3$) are determined via a calculational approximation based on the desired velocity change ($V_{ref}-V_0$) of the point of suspension, the beginning and desired final values ($\theta_0$, $\theta_{ref}$) of the oscillating angle and the beginning and desired final values ($\omega_0$, $\omega_{ref}$) of the angular velocity, and the predetermined duration ($\tau/4$), of each acceleration pulse, and wherein the magnitudes of the constant rate of acceleration differ in absolute value among the acceleration pulses.

* * * * *